United States Patent [19]

Konczalski

[11] Patent Number: 4,591,336

[45] Date of Patent: May 27, 1986

[54] OVEN FOR CURING RESIN-COATED WIRES

[75] Inventor: Ronald L. Konczalski, Grosse Ile, Mich.

[73] Assignee: Moco Thermal Industries, Rumulus, Mich.

[21] Appl. No.: 601,943

[22] Filed: Apr. 19, 1984

[51] Int. Cl.[4] ..... F27B 9/28

[52] U.S. Cl. ..... 432/59; 432/8; 432/153

[58] Field of Search ..... 432/8, 59, 143, 153

[56] References Cited

U.S. PATENT DOCUMENTS

| | | | |
|---|---|---|---|
| 2,143,525 | 1/1939 | Salerno | 432/153 |
| 2,750,680 | 6/1956 | Hondry et al. | 432/8 |
| 3,923,449 | 12/1975 | Brock | 432/59 |
| 4,039,278 | 8/1977 | Denholm | 432/153 |
| 4,165,964 | 8/1979 | Yonezawa et al. | 432/59 |

*Primary Examiner*—Henry C. Yuen

*Attorney, Agent, or Firm*—Kinzer, Plyer, Dorn & McEachran

[57] ABSTRACT

Wires having an adherent coating of resin are passed through individual, segregated chambers in a convection oven where the resin is cured; if a wire fails to feed, heat to the chamber for that wire is discontinued and its chamber is cooled by a draft of forced air while the remaining wire-treating chambers continue in operation.

6 Claims, 4 Drawing Figures

OVEN FOR CURING RESIN-COATED WIRES

INTRODUCTION

Background, Prior Art, The Problem

It is known to use a convection type curing oven in a process for applying an insulator coating to electrical wire, using a resin powder as the starting material for the insulator coating. The wire is fed from a supply reel at one end of the oven and passes through a wire cleaner into an electrostatic resin powder coater. This coater functions somewhat like a painting apparatus that uses electrostatic forces to obtain adherence, but the effective coating material is a resin powder.

From the powder coater the wire passes into a convection curing oven (which may be preceded by a radiant preheater) that heats and cures the resin adhering to the wire to afford a continuous resin coating on the wire. From the outlet of the convection curing oven the coated wire passes through cooling, test, and other apparatus to a take-up capstan.

In a typical installation four or more wires may be processed collectively on a simultaneous basis, the wires passing through a common work chamber into which very hot air (1000° F.) is circulated. Such an installation would not be economical if utilized for only a single wire.

The common work chamber through which all of the wires pass as a single set in the known convection curing oven installation is a source of substantial problems. The principal problem is that if any one of the wires breaks or its travel interrupted for any reason then all of the wires must be stopped and the oven temperature must be decreased to a much lower level. The reason for this is that at the high operating temperature (1000° F.) the wire cannot remain stationary in the oven without undergoing metallurgical alteration which results in unacceptable brittleness or breaking. Accordingly, to prevent this occurrence whenever any maintenance is necessary with respect to any one wire, it is necessary to bring the oven temperature down below 450° F. At that temperature, the insulation resin on the wire cannot be cured unless the system is operated at extremely low speeds. Once a remedy is effected, the oven has to be returned to the normal operating temperature. There is great waste of energy and time.

The problem is solved under the present invention by constructing the oven with individual narrow chambers (tubes), one for each wire instead of the common work chamber of the known system. Further, for each work tube or chamber a fan normally delivers hot air to the contained wire coated as aforesaid, but if one wire breaks or otherwise is interrupted in its passage through the oven, a damper for an individual fresh air intake to the work tube through which that wire passes is opened; in addition, a damper for an exhaust duct serving the same work tube is also opened, and the heater for that particular work tube is shut down. Now, the fan blows relatively cold air into and through the work tube to rapidly cool the work tube containing the disabled wire. After a remedy is effected, the dampers are closed, the heating means re-energized and normal operations are restored.

IN THE DRAWING

Figure 1:
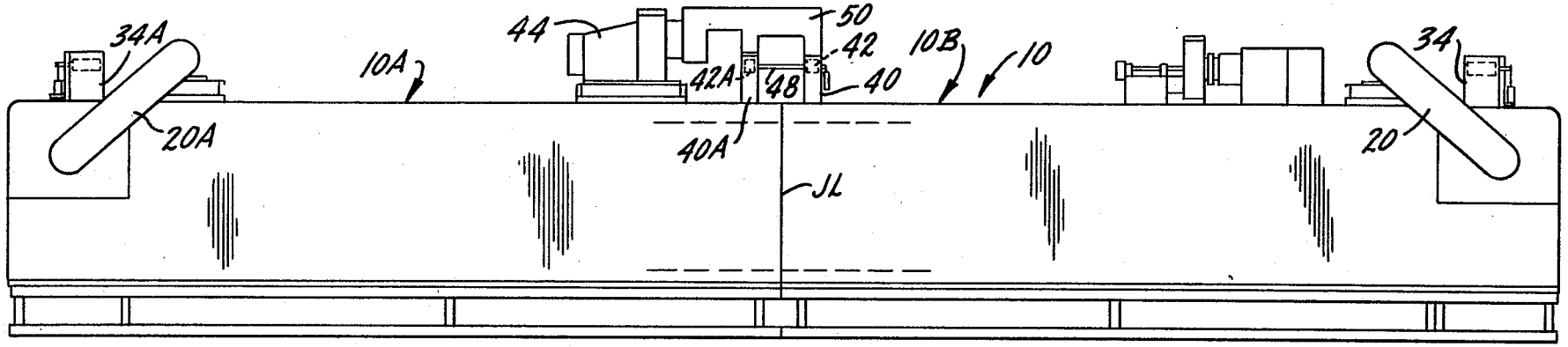
FIG. 1 is a side elevation of an oven constructed in accordance with the present invention.
Figure 2:
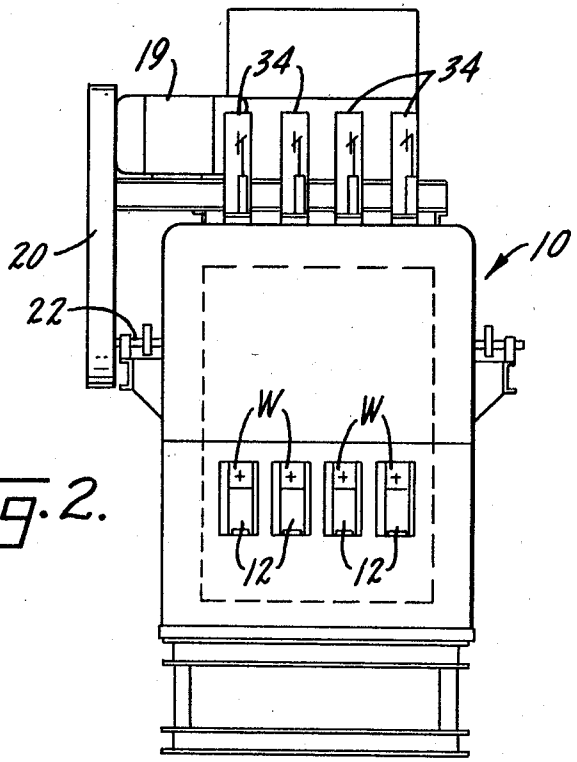
FIG. 2 is an end elevation of the oven, as viewed from the right of FIG. 1.

A side elevation of an elongated oven constructed in accordance with the present invention is identified by reference character 10 in FIG. 1, and as shown in the end elevation, FIG. 2, the lower part of the oven is provided with elongated, laterally separated individual chambers 12, four in number in the present instance, each to receive a stretched electrical conductor wire W delivered from a reel (not shown) spaced considerably from the right-hand entrance end of the oven as viewed in FIG. 1. Similarly, a take-up reel for the finished, treated wire would be located in spaced relation to the left-hand or exit end of the oven. Prior to admittance to the wire-treating chambers 12, each wire has been cleaned and passed through a coater chamber (not shown) where a resin powder is electrostatically adhered to the wire. This covering of adherent powder is heated and cured in the oven.

Figure 4:
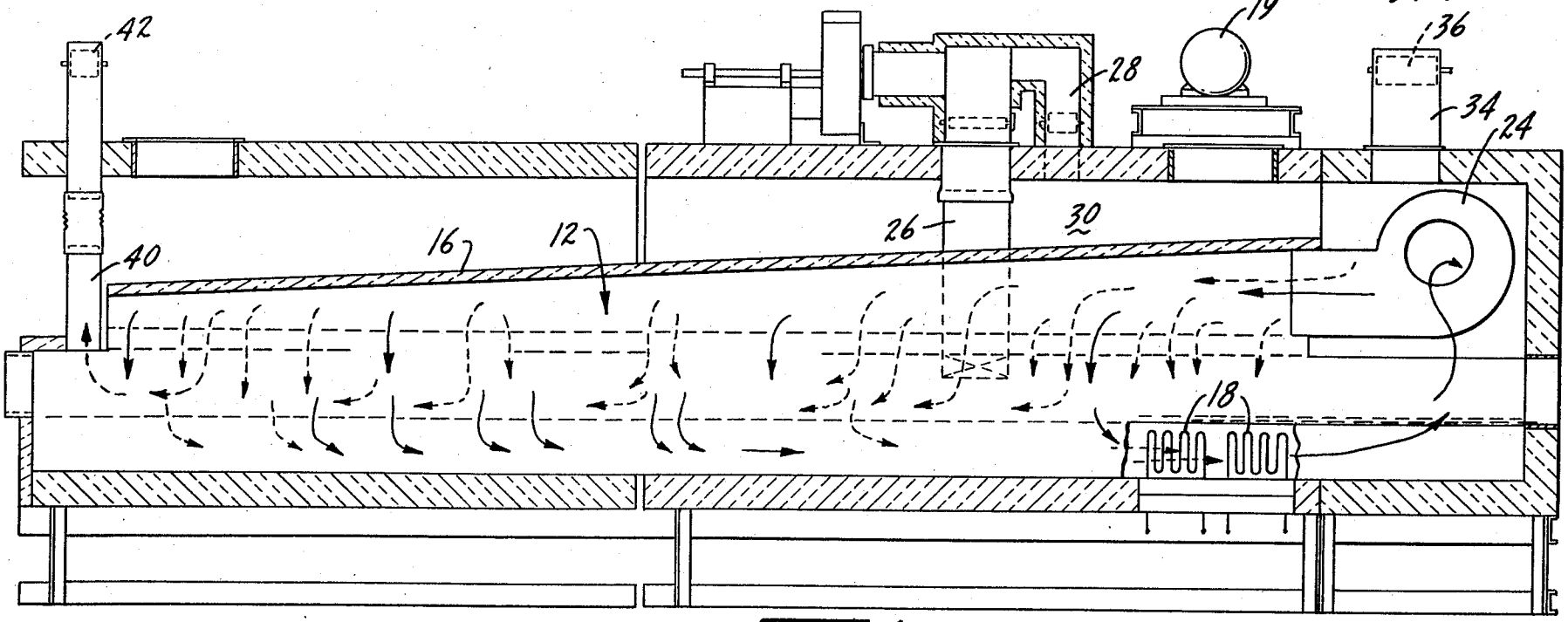
FIG. 4 is a section on the line 4—4 of FIG. 3.

Referring to the section, FIG. 4, the individual wire-treating chambers 12 are of perforate sheet metal tubing and are insulated from one another by insulator barriers 16; electrical resistance heater means 18 are positioned in separate chambers beneath each wire-treating chamber 12.

Figure 3:
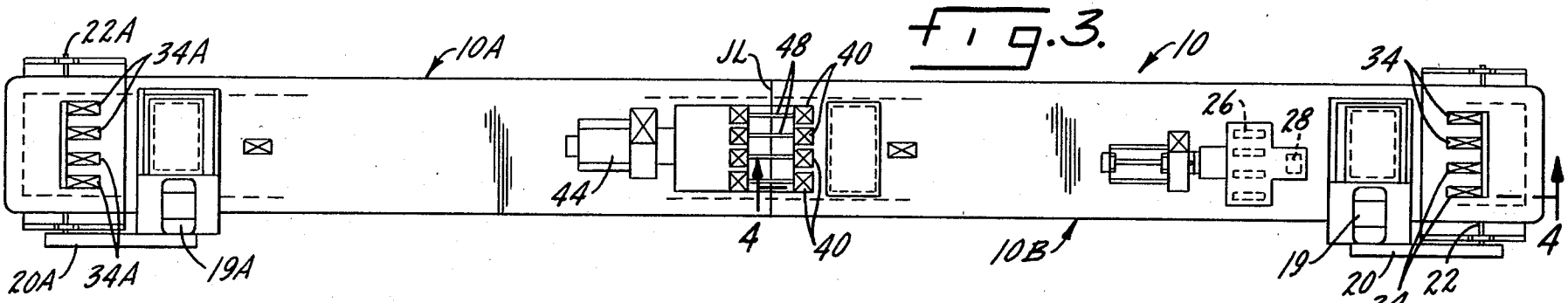
FIG. 3 is a top plan view of the oven.

A fan motor 19, FIGS. 2 and 3, is position on top of the oven housing at one end and through a pulley-belt housing 20 drives a fan input shaft 22. This shaft is employed to drive the individual fans, four in number as will be described, each fan being assigned to a corresponding wire-treating chamber. Thus the fan means is normally operable to circulate heated air through the perforate walls of the wire-treating chambers.

In accordance with safety standards, a mild exhaust duct 26 communicates with each wire-treating chamber to reduce the hazard of hot, loose resin particles collecting in a potentially explosive concentration, and a separate duct 28 removes any excess heat from the space 30, FIG. 4, which lies above the collective wire-treating chambers.

Thus it will be seen that in normal operation each of the coated wires in the course of its travel through the assigned chamber 12, is subjected to the effect of the related set of heating elements 18 beneath the related chamber, heating and curing the resin covering.

While there are circumstances where the fan means circulating hot air may be a single large purpose fan, the preference is for a single fan configuration 24, FIG. 4, each assigned to and servicing one chamber 12. As noted above these four fans are driven by a common shaft 22. The path of normal air for curing the resin is shown by solid arrows, FIG. 4, constantly circulated while the normally open ducts 26 and 28 remove any dust hazard and excess heat.

If a wire becomes disabled from making the transit through the oven it will become excessively heated and in order to prevent such overheating, the corresponding heating elements 18 will be disrupted by the supervisor. Prompt cooling, concurrent with disruption of power supply to the heating elements, is made possible by providing adjacent each of the fan means 24 individual fresh air inlet ducts 34, FIG. 2, one for each of the related wire-treating chambers. Each such duct, as shown in FIG. 4, is in communication with and feeds air to the related fan 24, and each duct is provided with a normally closed control damper 36. When a wire is to be cooled, the related damper 36 is located in full open position by the operator.

Additionally, four exhaust ducts as 40 are provided, one each in communication with a related wire-treating chamber. Each duct 40 has its own damper 42, normally closed, but located in the wide open position when a chamber 12 is to be cooled.

By this arrangement, cooling air (dashed arrows, FIG. 4) drawn through the air supply duct 34 having the open damper 36, and the forced draft exiting at the exhaust duct 40 having an open damper 42, is effective to cause a stream of cool air to move through the wire-treating chamber, forcefully driven by the associated fan configuration 24. The rate of movement of the cooling air may be increased by communicating the exhaust ducts 40 to an exhaust fan means 44. Thus, the blower fan 24 and exhaust fan 44 produce a stream of cold air straight through the wire tube. Nonetheless, the remaining wire-treating chambers continue in normal operation.

As shown in FIG. 1, the air inlet ducts and the associated fan drive (indicated by the suffix A added to the reference characters) are duplicated at the opposite end of the furnace. Thus during manufacture the construction may be so arranged that duplicated furnace sections 10A and 10B, FIG. 3, may be provided and these may be joined or spliced end to end at a joint JL as shown. Advantageously, for such construction, the exhaust ducts are also duplicated, as indicated by reference character 40A, FIG. 1, and the related dampers 42 and 42A are operated in unison by a common shaft 48. Two exhaust ducts as 40 and 40A are thus paired to a respective wire-treating chamber and the common exhaust, removed by a common fan and motor 44, is delivered to a common duct or manifold 50 which is in communication with the exhaust fan means 44.

I claim:

1. In an oven having an elongated housing through which electrical conductor wires are to be fed, the wires having an insulator resin powder adherent thereto as a covering which is to be heated and cured inside the oven to become part of the wire configuration:

a plurality of laterally spaced elongated wire-treating chambers inside the oven parallel to the long axis of the oven, each chamber being insulated by a barrier from the adjacent chamber and assigned to the passage and treatment of an individual wire;

separate heating means for each chamber disposed therebeneath for heating and curing the resin cover on each wire;

each wire chamber being so constructed that heated air may pass therethrough to effect curing of the resin cover on the associated wire, and fan means for circulating the heated air through each wire-treating chamber;

individual cooling air inlet ducts, each normally closed by a damper, in communication with said fan means for selectively admitting a draft of forced ambient air to a wire chamber for cooling that chamber upon opening the related damper in the event the wire in that chamber should fail to feed;

individual cooling air exhaust ducts each in communication with a related wire-treating chamber and each exhaust duct being normally closed by a damper;

whereby upon failure to feed a wire properly the wire not being fed may be cooled by opening the related inlet and exhaust ducts while disabling the related heating means and continuing operation of the fan means.

2. An oven according to claim 1 in which each wire-treating chamber has its own fan for circulating heated air and in which each inlet duct communicates with a related fan.

3. An oven according to claim 2 in which the exhaust ducts communicate with an exhaust fan.

4. An oven according to claim 1 in which the exhaust ducts communicate with an exhaust fan.

5. An oven according to claim 1 in which fan means for circulating heated air through each wire-treating chamber is duplicated at opposite ends of the oven, in which two sets of individual air exhaust ducts are located substantially medially of the oven in paired communication with respective wire-treating chambers, each pair of exhaust ducts having paired dampers on a common shaft, and a common exhaust fan for the two sets of exhaust ducts.

6. An oven according to claim 5 in which each wire-treating chamber has its own fan for circulating heated air and in which each inlet duct communicates with a related fan.

* * * * *